US008342777B2

(12) United States Patent
Baylot et al.

(10) Patent No.: US 8,342,777 B2
(45) Date of Patent: Jan. 1, 2013

(54) FLOATING SUPPORT INCLUDING A TURRET FITTED WITH A DISCONNECTABLE BUOY FOR MOORING BOTTOM-TO-SURFACE CONNECTION PIPES AND METHOD

(75) Inventors: Michel Baylot, Venice (IT); Jean-Paul Denise, Hyeres (FR); Thomas Marty, Aix en Provence (FR)

(73) Assignee: Saipem S.A., Montigny le Bretonneux (FR)

( * ) Notice: Subject to any disclaimer, the term of this patent is extended or adjusted under 35 U.S.C. 154(b) by 76 days.

(21) Appl. No.: 12/933,837

(22) PCT Filed: Mar. 18, 2009

(86) PCT No.: PCT/FR2009/050454

§ 371 (c)(1),
(2), (4) Date: Dec. 22, 2010

(87) PCT Pub. No.: WO2009/122099

PCT Pub. Date: Oct. 8, 2009

(65) Prior Publication Data

US 2011/0110724 A1 May 12, 2011

(30) Foreign Application Priority Data

Mar. 21, 2008 (FR) ..... 08 51833

(51) Int. Cl.
*B63B 22/02* (2006.01)

(52) U.S. Cl. ..... 405/224; 441/5; 114/230.13

(58) Field of Classification Search ..... 405/224, 405/224.2, 224.3, 224.4; 166/352–355; 441/3–5; 114/230.12, 230.13, 230.14; *B62B 22/02*
See application file for complete search history.

(56) References Cited

U.S. PATENT DOCUMENTS

| | | | | |
|---|---|---|---|---|
| 3,902,447 | A | 9/1975 | Slocum | |
| 4,604,961 | A * | 8/1986 | Ortloff et al. | 114/230.12 |
| 4,892,495 | A | 1/1990 | Svensen | |
| 5,065,689 | A | 11/1991 | Krogstad | |
| 5,240,446 | A * | 8/1993 | Boatman et al. | 441/3 |

(Continued)

FOREIGN PATENT DOCUMENTS

| | | |
|---|---|---|
| EP | 0259072 | 3/1988 |

(Continued)

OTHER PUBLICATIONS

International Search Report dated Sep. 4, 2009.

*Primary Examiner* — Frederick L Lagman
*Assistant Examiner* — Kyle Armstrong
(74) *Attorney, Agent, or Firm* — Cozen O'Connor

(57) ABSTRACT

The present invention relates to an oil production floating support having a releasable mooring system of anchor lines to the sea bottom and of bottom-surface connection pipes, the support comprising:

a mooring buoy for said anchor lines and first bottom-to-surface connection pipes; and a turret extending within a cavity passing through the entire height of the floating support, said mooring buoy being fastened under the hull of the floating support to said turret; and said floating support being characterized in that it includes a connection/disconnection system for connecting/disconnecting said mooring buoy relative to said bottom wall of the turret, which system comprises:

a plurality of hoist cables; and pump means for pumping water out from said valve chamber.

21 Claims, 5 Drawing Sheets

U.S. PATENT DOCUMENTS

| | | | | |
|---|---|---|---|---|
| 5,356,321 | A | 10/1994 | Boatman | |
| 5,381,750 | A * | 1/1995 | Pollack | 114/230.12 |
| 5,941,746 | A * | 8/1999 | Isnard et al. | 441/4 |
| 6,199,500 | B1 * | 3/2001 | Børseth et al. | 114/230.12 |
| 7,513,208 | B1 * | 4/2009 | Seaman et al. | 114/230.12 |
| 2008/0166936 | A1 * | 7/2008 | Lindblade | 441/3 |

FOREIGN PATENT DOCUMENTS

| | | |
|---|---|---|
| GB | 2291389 | 1/1996 |
| WO | WO 94/15828 | 7/1994 |
| WO | WO 99/10228 | 3/1999 |
| WO | WO 2007089157 A1 * | 8/2007 |

* cited by examiner

FLOATING SUPPORT INCLUDING A TURRET FITTED WITH A DISCONNECTABLE BUOY FOR MOORING BOTTOM-TO-SURFACE CONNECTION PIPES AND METHOD

PRIORITY CLAIM

This is a U.S. national stage of application No. PCT/FR2009/050454, filed on Mar. 18, 2009. Priority is claimed on the following application: France Application No. 0851833 Filed on Mar. 21, 2008, the content of which is incorporated here by reference.

FIELD OF THE INVENTION

The present invention relates to a floating support anchored to a disconnectable turret.

BACKGROUND OF THE INVENTION

The technical field of the invention is more particularly the field of off-shore oil production in regions presenting extreme ocean and weather conditions, and in particular in Arctic or Antarctic regions, and working from floating supports.

In general, an oil production floating support has anchor means to enable it to remain in position in spite of the effects of currents, winds, and swell. It also generally includes drilling means, oil storage means, and oil processing means, together with means for off-loading to off-loading tankers, which tankers call at regular intervals to take away the production. Such floating supports or ships are conventionally referred to as floating production storage off-loading (FPSO) vessels or indeed as floating drilling & production units (FDPU) when the floating support is also used for performing drilling operations with wells that are deflected in the depth of the water. The abbreviation FPSO is used below.

When weather and sea conditions, i.e. swell, wind, and current are severe or even extreme, as during storms, it is preferred to anchor the FPSO via a turret, generally situated in known manner in the front half of the ship and on its axis, with the ship being free to turn about said turret under the effect of the wind, current, and swell. Thus, with wind, current, and swell exerting specific forces on the hull and the superstructures, the FPSO makes use of its freedom to turn about the vertical axis ZZ so as to put itself naturally in a position of least resistance. The pipes connecting it with the well heads are generally connected to the underside of the turret and they are connected to the FPSO via a rotary joint lying on the axis of said turret. When weather conditions might become extreme, as in the North Sea, in the Gulf of Mexico, or in the Arctic or the Antarctic, the FPSO is generally disconnectable so as to be capable of taking shelter and waiting for acceptable operating conditions to return.

The present invention relates more particularly to a floating support for off-shore oil production in the Arctic or the Antarctic, the support being fitted under its hull with a disconnectable turret from where there extend anchor lines connected to the sea bottom and bottom-to-surface connection pipes, said hull including in its longitudinal direction substantially plane sides that extend vertically, and possibly also in conventional manner bow and stern portions (at the front and rear ends of the ship) that are inclined relative to the horizontal and that are preferably shaped so as to form a reinforced pointed stem capable of breaking pack ice merely by bending it whenever said pack ice forces it way under said reinforced stem.

Floating supports advantageously present a hull with substantially vertical longitudinal sides in order to optimize their oil storage capacities, and also to obtain better behavior in heavy sea. However a hull with vertical sides is particularly disadvantageous in terms of behavior relative to pack ice. Thus, in U.S. Pat. No. 4,102,288 and U.S. Pat. No. 4,571,125, floating supports are proposed that present, amongst other means, sides with profiles that are curved or inclined so as to enhance ice breaking in the manner that is known for a ship's bow having a stem that slopes relative to the horizontal.

In known manner, an oil production floating support including a releasable mooring system of anchor lines anchored to the sea bottom and of bottom-to-surface connection pipes comprises:

- a mooring buoy for said lines and bottom-to-surface connection pipes, said buoy preferably being an annular buoy; and
- said mooring buoy being fastened under the hull of the floating support to a rotary device having a tower-shaped structure referred to as a "turret", said turret being fastened to the hull within a cavity passing through the entire height of the hull of the floating support, said turret being rotatably mounted relative to said hull via at least one rolling or friction bearing, preferably a rolling bearing, so as to allow said floating support to turn about a substantially vertical axis ZZ' of said turret and of said cavity without causing said mooring buoy to turn relative to the same vertical axis ZZ'; and
- said bottom-to-surface connection pipes rise within the cavity to a coupling for a plurality of said pipes, said coupling being secured to the floating support level with the deck of the floating support, said coupling being rotatably mounted so as to allow said floating support to turn without turning said coupling that is referred to as a rotary joint coupling.

In the above-described prior art, the rolling bearing is located either level with the deck of the floating support, or else in the bottom portion under water, i.e. the bearing is immersed, or indeed a combination of the above two configurations may be used.

Embodiments in which the rolling bearing is located solely level with the deck are suitable only for floating supports of relatively small height, in particular less than 15 meters (m). With greater heights, for floating supports having a height lying in the range 20 m to 25 m, in particular, the horizontal force on the turret resulting from the floating support turning gives rise to the structure of the turret bending along its length, thereby mechanically stressing the top rolling bearing and thus mechanically endangering its reliability of operation. Furthermore, when the rolling bearing is underwater in the bottom portion of the turret, this immersion affects the operating reliability and the durability of said rolling bearing, and above all gives rise to difficulties in performing maintenance operations. On-site action requires the use of divers and of considerable technical means, and it is generally necessary to perform such operations in a protected zone, such as a fjord, or better still in a dry dock, after the FPSO has been disconnected. Thus, when an FPSO is intended to remain in position for several tens of years without any programmed maintenance disconnections in dry dock or in a protected site, that type of turret is not suitable.

Supports of the above-defined type are known from GB 2 291 389 and EP 0 259 072.

WO 94/15828 describes a system for quickly connecting and disconnecting a mooring buoy, in which the mooring buoy has a top portion that is connected to the bottom of the hull of the floating support, more precisely via a mooring cavity that extends annularly at the bottom end of a cavity passing through the entire height of the hull of the floating support with the bottom-to-surface connection pipes passing up therethrough. The mooring buoy also has a bottom portion to which there are moored the bottom portions of bottom-to-surface connection pipes extending to the sea bottom, said bottom portion of the mooring buoy being rotatably mounted by means of a rolling bearing that is completely immersed, enabling said bottom portion to turn relative to the top portion of the mooring buoy secured to the hull.

That type of system with a completely immersed rotary portion and rolling bearings that are completely immersed is not suitable for mooring a large number of bottom-to-surface connection pipes, for which it is desirable to propose a system in which at least some of the rolling bearings are situated out of the water so that they can be maintained more easily and so that they can be implemented in operating conditions that are less constraining.

In WO 94/15828, provision is made at the bottom of the hull for internal tanks presenting a large area in horizontal section in which atmospheric pressure or preferably a vacuum is established, said internal tanks presenting a large area of contact in horizontal section with the top portion of the mooring buoy, with the buoy being designed to be fastened thereagainst. For this purpose, an interstitial annular zone is created between the mooring buoy and the tank at atmospheric pressure at the bottom of the hull of the ship, which zone is defined by two concentric annular gaskets, which annular zone of small volume is put into contact with the chamber at atmospheric pressure at the bottom of the hull of the ship in order to create positive buoyancy for the assembly constituted by the mooring buoy and the anchor lines and the bottom-to-surface connection pipes that are pressed against said contact area.

SUMMARY OF THE INVENTION

An object of the present invention is to provide a connection/disconnection system for a mooring buoy that is faster and simpler to implement, being based on the principle of using pump create means to positive buoyancy for the mooring buoy and the bottom-to-surface connection pipes that are moored thereto with said mooring buoy being fastened to a rotary turret within a cavity that extends over the entire height of the hull of the ship, such that no portion of the mooring buoy is stationary relative to the hull of the ship and said mooring buoy includes at least one rolling bearing that is not immersed while it is in operation.

To achieve this, the present invention provides an oil production floating support including a disconnectable mooring system of anchor lines anchored to the bottom of the sea and of bottom-to-surface connection pipes, the support comprising:

- a mooring buoy for said anchor lines and first bottom-to-surface connection pipes extending from said buoy, to which they are moored, down to the bottom of the sea, said buoy preferably being an annular buoy; and
- a turret extending in a through cavity passing along the entire height of the hull of the floating support, said mooring buoy being fastened under the hull of the floating support to said turret, said turret co-operating with the hull within said through cavity passing along the entire height of the hull of the floating support, said turret being rotatably mounted relative to said hull by means of at least one rolling or friction bearing situated above the water line and/or out of the water, preferably a rolling bearing, so as to allow said floating support to turn about a substantially vertical axis ZZ' of said turret and of said cavity without causing said mooring buoy to turn relative to the same vertical axis ZZ'; and
- said turret including at least one watertight tubular structure, preferably of circular section about said vertical axis, having a bottom wall assembled in watertight manner to the bottom end of the tubular side wall of said tubular structure; and
- second connection pipes between the top ends of said first bottom-to-surface connection pipes and the deck of the floating support, passing in watertight manner through the bottom of the turret and rising within the cavity to a coupling for coupling a plurality of said second pipes, said coupling being secured to the floating support preferably at the level of the deck of the floating support, said coupling being of the rotary joint coupling type and being rotatably mounted so as to allow said floating support to turn without turning said coupling;

the support being characterized in that:

- said mooring buoy comprises a top tubular wall having said valves situated therein preferably together with connectors, said tubular top wall of the buoy co-operating with the bottom wall of said turret to define a watertight chamber, referred to as a "valve" chamber, when the top edge of said tubular top wall of the buoy is pressed against the bottom wall of said turret, against the underface thereof; and
- said floating support includes a connection/disconnection system for connecting/disconnecting said mooring buoy relative to said bottom wall of the turret, said system comprising:
  - a plurality of links such as hoist cables fastened to said mooring buoy, preferably to the top edge of said tubular top wall of the mooring buoy, said links preferably extending inside the turret and passing through the bottom wall of the turret in leaktight manner; and
  - at least one vent tube extending vertically inside the turret from a level above the water line to the bottom wall of the turret and passing through the bottom wall in watertight manner; and
  - pump means for pumping the water in said valve chamber when said tubular top wall of the buoy is pressed against said bottom of the turret; and
  - the dead weight of said mooring buoy and of said first bottom-to-surface connection pipes and of the anchor lines being less than the weight of the volume of water corresponding to the volume $V=S\times(H_0-H_2)$, in which:
    - $H_0$ is the height of the water at the water line;
    - $H_2$ is the height of the top edge of said top tubular wall of the buoy in contact with the bottom wall of the turret; and
    - S is the area of the cross-section of said top tubular wall (1*a*).

It can be understood that, when the top edge of the tubular wall of said tubular top wall of the buoy is pressed against the bottom of the turret, said valve chamber being full of water, positive buoyancy is established for the assembly comprising the buoy and the bottom-to-surface connection pipes when water is pumped from inside said valve chamber so that the level of water in said guide tubes lies between $H_1$ and $H_2$, $H_1$ corresponding to the height at which the volume $V_1$ of water given by $V_1=S\times(H_0-H_1)$ is equal to the dead weight of said buoy and said first bottom-to-surface connection pipes and said anchor lines. When the dead weight of the assembly constituted by the buoy and said first connection pipes and anchor lines exceeds the weight of the volume $V_1$ of water, where $V_1S\times(H_0-H_1)$, the buoy begins naturally to release itself from the turret and to move downwards. As soon as the annular buoy becomes detached from the bottom of the turret, it returns to a hydrostatic pressure level corresponding to the level of the depth of the sea, said annular buoy then being caused to move downwards with considerable force corresponding to its own weight, i.e. 500 (metric) tonnes (t) to 1500 t, thus releasing the floating support from its anchoring via the turret in almost instantaneous manner.

To achieve this, the valve chamber is filled with water while said vent tubes maintain the valve chamber substantially at atmospheric pressure during filling, until the level of water in said tubes reaches a height above $H_1$.

Preferably, the plurality of the hoist cables extends from winches that are preferably located on the deck of the ship or at the top of the turret, above the water line, the cables where appropriate extending inside a plurality of vent and tubes serving as guide, hereinafter also called "guide tubes", extending vertically inside the turret from a level above the water line down to the bottom of the turret through which they pass in watertight manner.

Also preferably, the floating support of the invention includes at least three said cables and at least three said guide tubes, preferably disposed symmetrically about the center of the circular bottom of said turret, and preferably along and close to the inside surface of said tubular structure of said turret, the bottom ends of said cables being fastened to the top edge of said top tubular wall of said buoy.

This arrangement of said cables makes it possible to cause said mooring buoy to advance and approach the underface of the bottom of the turret in controlled and stable manner by synchronizing the actuation of the winches winding in said hoist cable.

More particularly, the diameter of said guide tubes and the immersion depth $H_0$-$H_2$ of the bottom wall of the turret on which said guide tubes rest are such that the inside volume of the guide tubes is less than 15 $m^3$, preferably less than 5 $m^3$, for a turret having an immersed height $H_0$-$H_2$ within said cavity of at least 20 m, and more particularly preferably of 20 m to 50 m.

Still more particularly, said top tubular wall of the buoy includes at its bottom end a bottom wall to which it is assembled in watertight manner, forming the bottom wall of the valve chamber supporting said valves and/or automatic connector portions, and in its bottom portion the buoy includes an annular buoyancy tank constituting a float against the underface of the bottom wall of the valve chamber.

It can be understood that the tubular top wall of the buoy presents a height that is necessary and sufficient for installing said valves and automatic connectors for connecting together the first and second pipes.

Still more particularly, the floating support includes a pump situated in the bottom portion inside said watertight tubular structure constituting the turret, said pump co-operating with a suction pipe passing in watertight manner through said bottom wall of the turret, said suction pipe coming close to the bottom wall of said valve chamber when it is in position pressed against said bottom wall of the turret, and said pump co-operating with a delivery pipe passing through the tubular side wall of said watertight tubular structure constituting the turret, preferably in the bottom portion of said turret, and opening out into said cavity.

Advantageously, the floating support includes centering posts applied against the outside surface of the tubular wall of the turret and extending below said bottom wall of the turret, preferably being placed uniformly and regularly around said bottom.

It can be understood that said centering means facilitate centering the tubular top wall of said mooring buoy relative to said turret as it approaches the underface of said bottom of the turret and makes it easier to connect the male and female portions of the automatic connectors at the top ends of said bottom-to-surface connection pipes projecting above the bottom of said valve chamber with the bottom ends of said second connection pipes.

Also advantageously, the floating support includes reversible mechanical retaining means for retaining said mooring buoy against the underface of the bottom of said turret.

Still more particularly, said tubular top wall of said buoy has an annular gasket on its top edge, and has protective posts or abutments on its inside face for limiting the flattening of said gasket and for transferring vertical loads between said annular buoy and the turret when said mooring buoy is pressed against the bottom wall of said turret, said annular gasket being compressed between the underface of the bottom wall of said turret and the top edge of the tubular top wall of said mooring buoy, said protective post being suitable for co-operating with a hinged movable safety latch secured to the underface of the bottom wall of said turret, whereby said mooring buoy is secured to said turret when said safety latch is engaged under said protective post.

Thus, in the event of the valve chamber being flooded with sea water as the result of a leak, the total loss of buoyancy by the mooring buoy is compensated by the fastening achieved using said safety latches and there is no risk of said mooring buoy being cast off in untimely and destructive manner.

Preferably, said top tubular wall of the buoy and/or the tubular side wall of the watertight tubular structure of said turret include(s) a filler valve co-operating with filler pipes for putting sea water into communication with the inside of said valve chamber, and said tubular wall of said valve chamber preferably includes a watertight hatch of large dimensions suitable for enabling said valve chamber to be filled almost instantaneously by sea water when said hatch is opened.

More particularly, the bottom wall of the turret includes an inspection hatch for inspecting said valve chamber.

Because it is possible to empty the valve chamber, that makes it possible for personnel to act in the dry in said chamber for maintenance purposes, and where appropriate for operating automatic connectors and valves providing the connections between said first and second pipes.

The present invention also provides a method of operating a floating support of the invention, wherein a said mooring buoy is connected to the underface against the bottom wall of a said turret by performing the following steps:

a) immersing a said mooring buoy, said buoy having said first bottom-to-surface connection pipe and anchor lines moored thereto; and b) securing the bottom ends of hoist cables to said mooring buoy, said floating support being positioned in such a manner that said mooring buoy is substantially on the vertical axis of said cavity; and c) actuating said winches to raise said mooring buoy until the top edge of said tubular top wall of the mooring buoy is pressed against the underface of the bottom wall of said turret, thereby forming a said valve chamber that is filled with sea water, said guide tubes also being filled with sea water up to a height $H_0$ corresponding substantially to the level of the water surface at the water line; and d) pumping out the water inside said valve chamber using said pump means until the level of water in said guide tubes is less than the height $H_1$, preferably less than or equal to the height $H_2$, where the height $H_1$ is such that the weight of the volume V1 of water, where $V1=S\times(H_0-H_1)$, is equal at least to the weight of the assembly of said mooring buoy and of said connection pipes and said anchor lines; and e) preferably completely emptying said valve chamber and then making it watertight.

As mentioned above, $H_2$ represents the height relative to the sea bottom of the top edge of the tubular top wall of the buoy and the height of the underface of the bottom wall of the turret when they are in contact with each other, and S is the area of the cross-section of the tubular top wall of the turret or the area of the bottom wall of the turret as defined by the top edge of the tubular top wall of the turret when they are in contract.

More particularly, after said valve chamber has been emptied, the bottom ends of said hoist cables are detached from said mooring buoy, and preferably retaining means for mechanically retaining said mooring buoy are engaged, thereby securing the buoy to the bottom wall of said turret, preferably using a hinged movable safety latch suitable for co-operating with protective posts preventing an annular gasket that is compressed between the top edge of the tubular top wall of the mooring buoy and the underface of the bottom wall of the turret from being flattened.

The present invention also provides a method of operating a floating support of the invention, wherein it is disconnected from a said mooring buoy connected to a said turret, wherein, after the bottom ends of said hoist cables have been separated from said mooring buoy, the method comprising the following steps:

a) causing water to enter into the valve chamber, so that the water level in said guide tubes comes to above said level $H_1$; and b) where appropriate, releasing the automatic connectors between said first and second pipes and releasing said mechanical retaining means in order to separate said mooring buoy mechanically from said bottom wall of the turret.

Preferably, the following steps are performed:

a) preferably, and where appropriate, depressurizing said first and second bottom-to-surface connection pipes, in particular to their connection points with the sea bottom, in particular at a well head so as to avoid any untimely and dangerous decompression of gas in the vicinity of the valve chamber; and b) filling said valve chamber up to said height $H_2$ of the underface of the bottom wall of the turret, and stopping filling as soon as said valve chamber is completely full of water; and c) releasing the automatic connectors between said first and second pipes; and d) releasing, where appropriate, said mechanical safety latches; and e) continuing to fill said valve chamber so as to fill the guide tubes up to said height $H_1$, or even $H_0$.

In step a), said guide tubes serve as vents to maintain the valve chamber substantially at atmospheric pressure while it is being filled.

This two-stage disconnection technique is advantageous since, from the end of step a) and up to step d) inclusive, the mooring buoy is held in position by hydrostatic thrust and the process of casting off the mooring buoy remains reversible merely by emptying the chamber, thus making it possible to provide an intermediate disconnection stage or waiting stage in the event of it not being certain that the mooring buoy needs to be disconnected but in which it is desirable to be ready to be able to perform said disconnection as quickly as possible, should that become necessary, with this being done merely by filling the guide tubes in accordance with above step e). Thus, in the event of danger that is imminent but not certain, such as drifting pack ice or an iceberg, the preparatory stage which remains reversible is performed calmly (steps a) to d)), which stage might take several hours if it is necessary to burn off depressurization gas via the flare tower. Once it is confirmed that disconnection needs to be performed, the second stage (step e)), which step is irreversible, lasts for only a few tens of seconds or a few minutes, thereby enabling the buoy to be cast off and thus releasing the FPSO almost instantaneously from its anchoring.

BRIEF DESCRIPTION OF THE DRAWINGS

Other characteristics and advantages of the present invention appear better in the light of the following detailed description made in non-limiting and illustrative manner, with reference to the drawings, in which.

DETAILED DESCRIPTION OF THE PRESENTLY PREFERRED EMBODIMENTS

Figure 1:
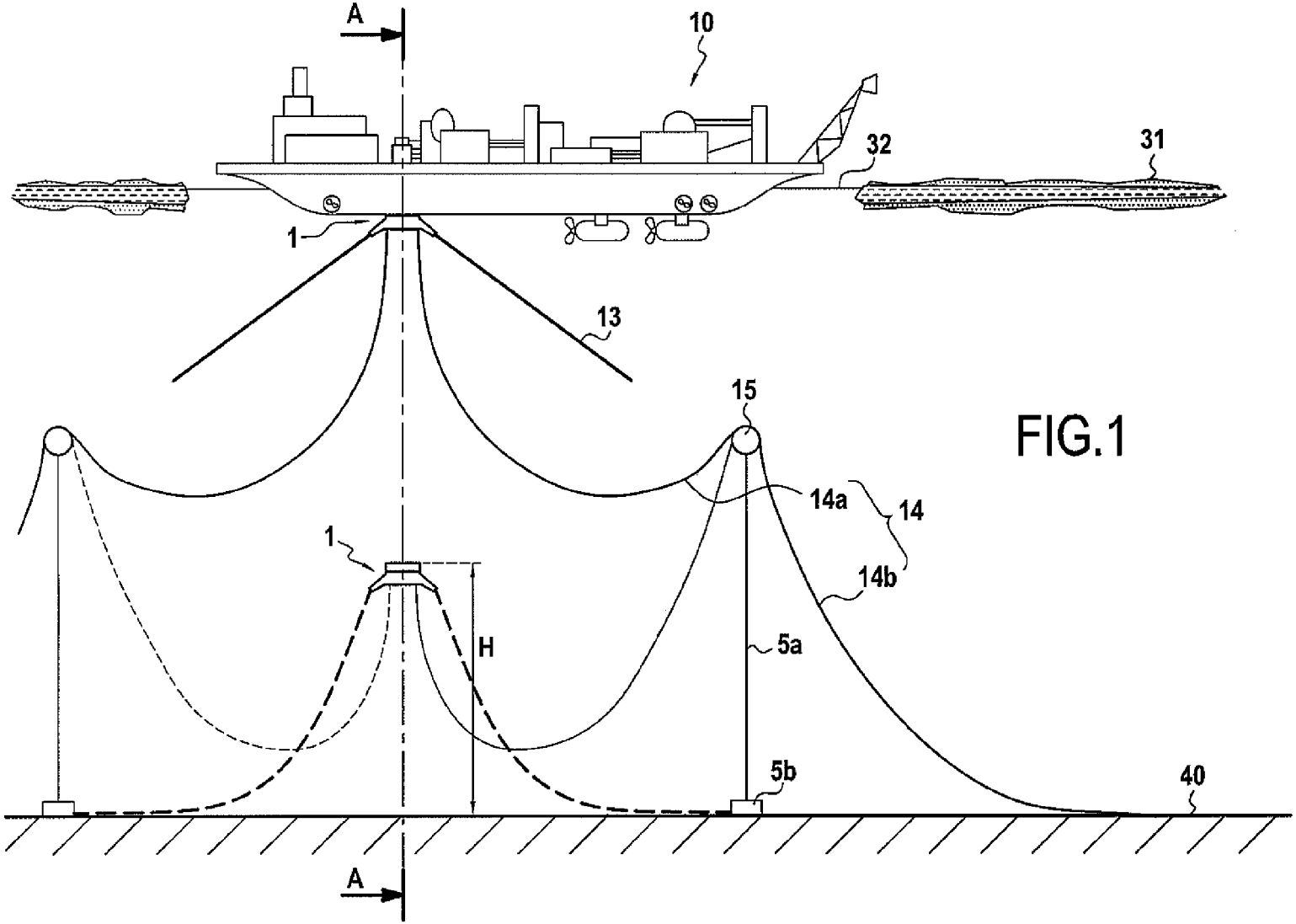
FIG. 1 is a side view in section of an FPSO anchored on a turret within pack ice.
Figure 3:
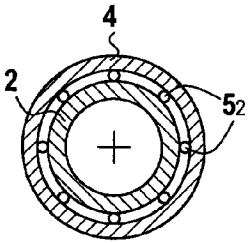
FIG. 3 is a section on III-III of FIG. 2A through a top rolling bearing.

FIG. 1 is a side view in section showing a ship or floating support of the FPSO type 10 anchored on a turret of a releasable mooring system 1, 2, 3 anchored by anchor lines 13 and connected to undersea well heads (not shown) via flexible pipes 14 in a dipping catenary configuration 14*a* going down to a subsurface float 15 supporting said pipe, said float being held by a cable 15*a* connected to a mooring block or "deadman" 15*b* at the bottom of the sea, after which said flexible pipe 14*a* extends in a catenary configuration 14*b* down to the bottom of the sea 40 and then to said well heads. The FPSO is in cold water in which icebergs or pack ice 31 of large area and considerable thickness can be present floating on the surface of the sea 32. In certain extreme conditions, such as storms or when the pack ice is so thick that the ice breaker-shaped bow of the ship cannot break it as it advances, it is necessary to disconnect the FPSO to allow it to take shelter while waiting for the situation to return to normal. For this purpose, the bottom portion 1 of the mooring system, commonly referred to as a "spider buoy" is constituted by an annular mooring buoy 1 that can be disconnected in a manner known to the person skilled in the art, generally from the bottom of the FPSO, thereby enabling said FPSO to be released so that it can take shelter. More particularly, the mooring buoy 1 and the underwater pipe sections 14 are connected to the bottom 2*c* of the turret via the underface of said bottom by means of automatic connectors 7. The internal buoyancy of the annular mooring buoy 1 is adjusted in such a manner that said buoy stabilizes at a height H above the bottom of the sea, e.g. corresponding to a distance of 100 m from the surface of the sea 32, thereby putting all of the anchor lines and pipes in a sheltered position, as also shown in FIG. 1.

Figure 2A:
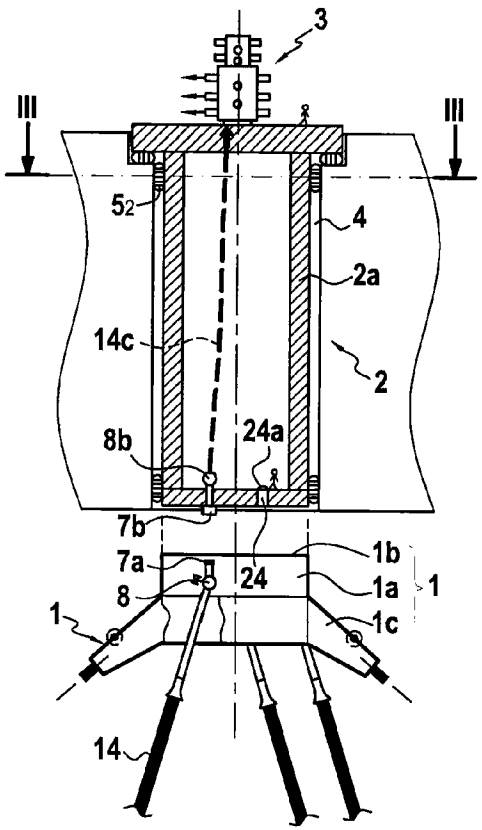
FIG. 2A shows the mooring buoy being cast off in order to allow the FPSO to take shelter.
Figure 2:
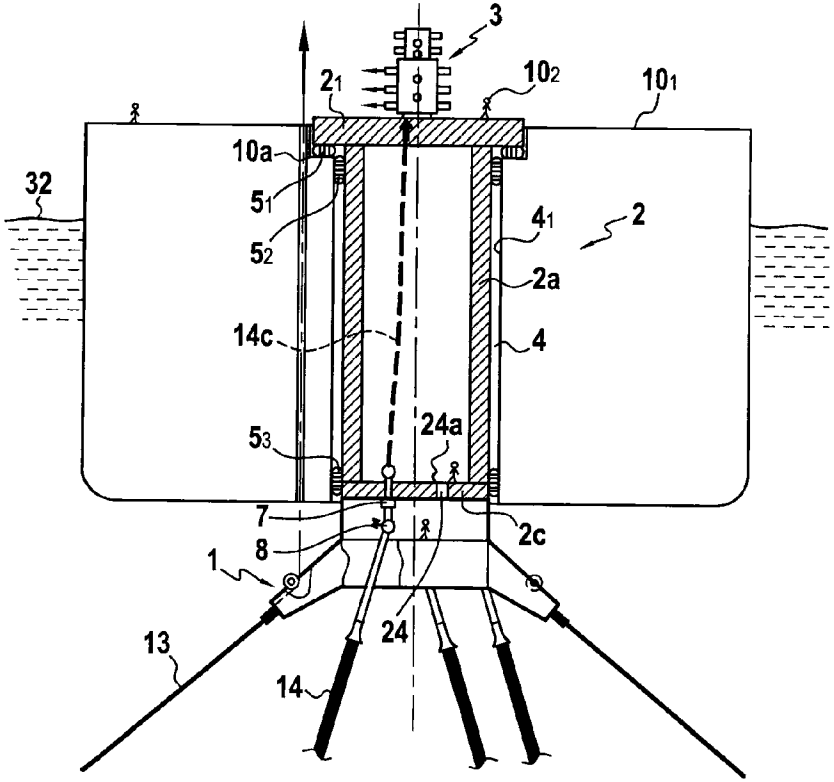
FIG. 2 is a section on plane AA of FIG. 1 showing the FPSO and the turret of the invention in section with the mooring system comprising the turret of the invention, the mooring buoy supporting the anchor lines and the bottom-top connection pipes, said buoy being connected to the base of the turret, and with the rotary joint coupling (3) being located at the level of the deck of the floating support.

In FIG. 2, there can be seen the entire disconnectable mooring system 1, 2, 3 of the present invention including an annular mooring buoy 1:

said mooring buoy is fastened under the hull of the floating support, at the underface of the bottom 2*c* of the turret 2, said turret extending over the full height of a cavity 4 passing through the entire height of the hull of the floating support;

said turret 2 is rotatably mounted relative to said hull by means of three rolling bearings $\mathbf{5}_1$, $\mathbf{5}_2$, $\mathbf{5}_3$, as described below, enabling said floating support to turn about a vertical axis ZZ' of said turret and of said cavity without causing said turret 2 and said mooring buoy 1 to turn; and said mooring buoy enables the underwater top ends of the first bottom-to-surface connection pipes 14 fitted with male portions 7*a* of the automatic connectors to be connected to the bottom ends of said second pipes 14*c* fitted with female portions 7*b* of the automatic connectors at the underface of the bottom wall of the turret, said second pipes rising within the cavity 4 up to a rotary joint coupling 3 located level with the deck $\mathbf{10}_1$ of the hull on the platform $\mathbf{2}_1$ at the top end of the turret.

In known manner, the rotary joint coupling 3 is mounted free to rotate so as to allow said floating support to turn without causing said coupling to turn together with the pipes that are connected thereto in the floating support.

For greater clarity, in FIGS. 2 to 8, only one said second pipe 14*c* is shown passing through the turret from a female portion 7*b* of an automatic connector 7 at the underface of the bottom wall 2*c* of the turret.

FIG. 2 is a side view in section showing the FPSO in section on plane AA of FIG. 1. The turret 2 is installed in a preferably circular cavity 4 that passes vertically through the entire height of the FPSO 10 from its deck $\mathbf{10}_1$ to the bottom of its hull. The top portion of the cavity 4 presented a step 10*a* for the top portion $\mathbf{2}_1$ of the turret. Sea water is present inside said cavity 4 of the FPSO and outside the turret.

The turret 2 is a tubular structure that is made watertight at its bottom end by a bottom wall 2*c* and that includes at its top end a top platform $\mathbf{2}_1$ of greater diameter than the tubular side wall 2, said platform having its peripheral portions that project beyond the tubular side wall 2 bearing against the step 1*a* at the top end of the cavity 4.

The turret has three rolling bearings, namely:

a top support bearing $\mathbf{5}_1$; and a top lateral guide bearing $\mathbf{5}_2$; and a bottom lateral guide bearing $\mathbf{5}_3$.

Said bearings $\mathbf{5}_1$, $\mathbf{5}_2$, $\mathbf{5}_3$ are friction bearings or rolling bearings, and they are preferably rolling bearings. More particularly, they may comprise rollers or wheels interposed between:

the inside wall $\mathbf{4}_1$ of the cavity 4 and the outside surface of the tubular side wall 2, for the lateral guide rollers or the wheels $\mathbf{5}_2$ and $\mathbf{5}_3$; and the step 10*a* and the top platform $\mathbf{2}_1$ of the turret 2, for the support bearing $\mathbf{5}_1$.

It can be understood that at least at said bearings, said tubular structure 2 and said cavity inside wall $\mathbf{4}_1$ are of circular section. The rollers or wheels of the bottom and top lateral guide bearings $\mathbf{5}_2$ and $\mathbf{5}_3$ are more particularly disposed with their axes of rotation in a vertical position. For the top support bearing $\mathbf{5}_1$, said rollers or wheels are disposed with their axes of rotation in a horizontal position bearing against the step 1*a*, with the platform $\mathbf{2}_1$ resting on the top edges of said rollers $\mathbf{5}_1$.

By way of example, in order to install a large number of pipes for gas, crude oil, hydraulic umbilicals, and electric cables, e.g. 36 or 48 pipes 14, together with all of their safety and control elements, the outside diameter of said tubular structure of the turret 2 may exceed 25 m, and more particularly its diameter may be 10 m to 20 m, and its wetted height is generally greater than 20 m, possibly being as much as 25 m or even more when the hull of the floating support extends over a height of 50 m, as sometimes happens.

When the ship is severely stressed, either by pack ice or by swell, wind, or current, its anchor system connected to the annular mooring buoy 1 keeps it in position. Given the large dimensions of the FPSO, the reaction forces of its anchoring give rise to considerable variations in horizontal tension F at the base of the turret, possibly reaching 5000 t to 7500 t for pack ice advancing perpendicularly to the side of the FPSO, and reaching 1500 t to 3000 t under extreme conditions of swell, wind, and current. These horizontal forces are transmitted directly by the annular mooring buoy to said base of the turret.

Figure 4:
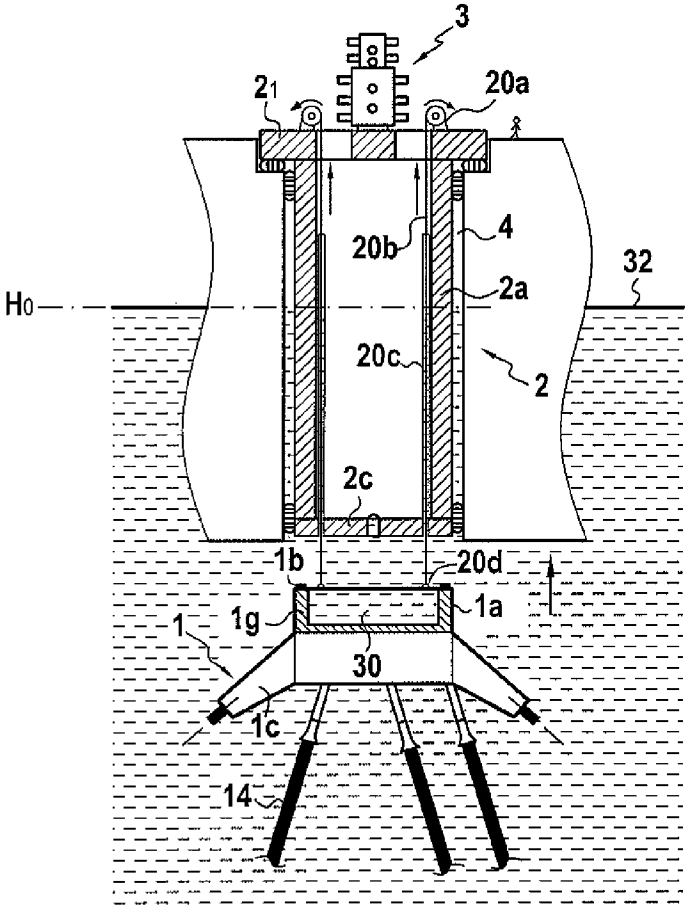
FIG. 4 is a side view in section showing the buoy being connected to the turret by means of winches and cables.

FIG. 4 is a section view on plane AA of FIG. 1, showing the annular buoy being connected to the turret. Cables 20*b*, at least two cables and preferably three cables, and preferably regularly and uniformly spaced apart inside said turret against the inside cylindrical surface of the wall of the tubular structure 2, are connected to winches 20*a* that are secured to the turret and that are installed at the top portion thereof well above the water line 32, and preferably on the platform $\mathbf{2}_1$. Said cables 20*b* pass through a vertical pipe or guide tube 20*c*, which projects by several meters, e.g. 5 m, from the maximum level of swell that might strike the side of the ship, said maximum level being well above the level of the sea at rest, as represented by reference 32 in FIG. 4. Said guide pipe 20*c* extends vertically downwards and passes in watertight manner through the bottom 2*c* of the turret 2. Thus, the level of sea water inside the guide pipe 20*c* remains substantially the same as at the side of the ship, i.e. at the level $H_0$ that corresponds, in said figure, to sea level 32: in the event of a large amount of swell or a storm, the level of water in said pipe 20*c* cannot reach the top of said pipe and there is no risk of sea water penetrating into the inside of the turret 2. With the annular buoy being in a rest position at a height H above the sea bottom, as shown in FIG. 1, the FPSO takes up position substantially vertically above the annular buoy and a remotely-operated vehicle (ROV) is used to connect the ends of the cables 20 to said buoy once they have been lowered to the desired depth by being unwound from the winches 20*a*. The buoy is then raised towards the bottom of the turret by winding in all of the winches synchronously until the top portion of the annular buoy comes into contact with the bottom portion of the turret. For this purpose, guide means 21 (see FIG. 8) are provided that are secured to said turret and that serve to center the annular buoy 1 relative to the turret, thereby making it easier to connect together the male and female portions 7*a* and 7*b* of the automatic connectors 7. A circular elastomer gasket 100 secured to the annular buoy is compressed between the underface of the turret and the top portion of the annular buoy, with a post 101 secured to said annular buoy limiting the extent to which said gasket can be compressed and serving to transfer vertical loads between said annular buoy and the turret.

These posts 101 are pressed against the outside surface of the watertight tubular structure 2 and they extend beneath it, i.e. below the level of the bottom 2*c* of the tubular structure 2 so as to take up the horizontal forces to which the mooring buoy 1 is subjected.

The top portion of the mooring buoy 1 is constituted by a top tubular wall 1*a* that is preferably of circular section and that defines a chamber 30 containing the top ends of the first pipes 14 that pass through the bottom 30*a* of the chamber 30. Said top ends of the first pipes 14 and the bottom ends of the second pipes 14*c* are fitted with respective valves 8 and 8*b* and respectively with the male portions 7*a* and the female portions 7*b* of automatic connectors 7. The gasket 100 is pressed against the top edge 1*b* constituting the edge face of the top tubular wall la of the mooring buoy 1.

The valves 8 and the male portions 7*a* of the automatic connectors 7 at the top ends of the first pipes 14 are supported by the bottom 30*a* of the valve chamber 30.

The valves 8*b* and the female portions 7*b* of the automatic connectors 7 at the bottom ends of the second pipes 14*c* are supported by the bottom wall 2*c* of the turret.

The mooring buoy 1 has a bottom portion 1*c* forming an annular buoyancy tank that constitutes a float at the underface of the bottom wall 30*a* of the valve chamber 30.

Figure 5:
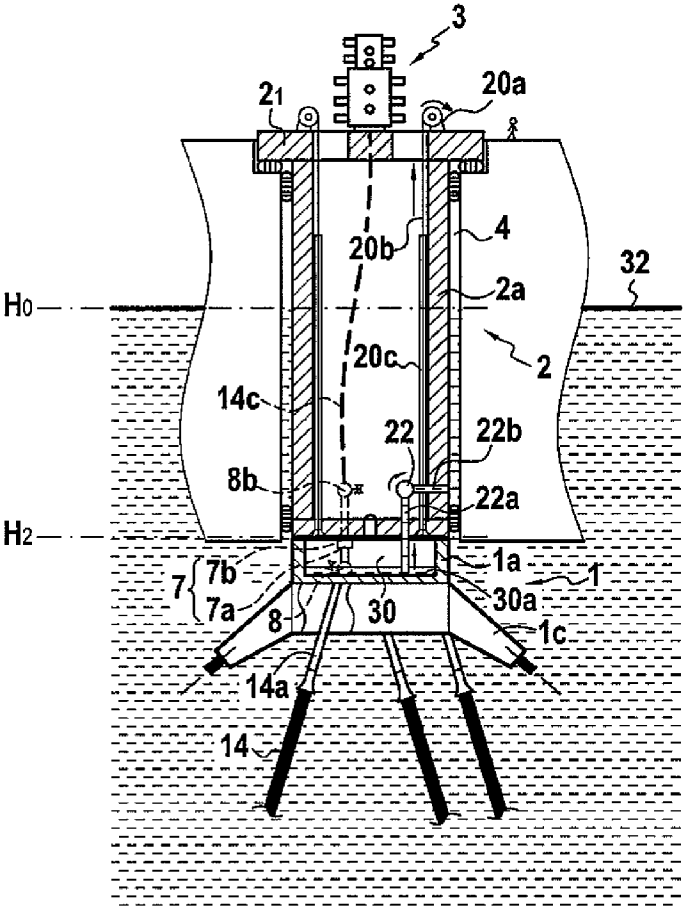
FIG. 5 is a side view in section showing the turret being deballasted by means of a bilge pump, the top portion of the buoy corresponding to the valve chamber.

When docking of the annular buoy against the turret is completed, tension is maintained in the cables 20*b* and the valve chamber 30 is deballasted as described in detail with reference to FIG. 5.

For this purpose, a pump 22 sucks out the water through a suction pipe 22*a* that passes in watertight manner through the bottom 2*c* of the turret and the water is rejected to the sea via a delivery pipe 22*b* that passes in watertight manner through the turret 2. At the beginning of pumping, the water inside the guide pipes 20*c* is at the level $H_0$, corresponding substantially to sea level, but once a few hundred liters have been pumped out, the water drops down to the level $H_2$, since the diameter required for the pipes is associated with the diameter of the hoist cables 20*b* and is advantageously kept to a minimum. By way of example, a guide pipe having an inside diameter of 300 millimeters (mm) and a height $H_0$-$H_2$ of 20 m and containing a hoist cable with a diameter of 150 mm corresponds to a volume of water that is about 1 cubic meter ($m^3$), i.e. a total volume of about 4 $m^3$ for a four-strand hoist system. A deballasting pump that operates at 500 cubic meters per hour ($m^3$/h) can thus empty the entire height of said guide pipes in about 30 seconds (s) and can then begin to empty the valve chamber which has a volume of about 2000 $m^3$, if the chamber has a height of 5 m and a diameter of 22.5 m.

Thus, after the first 4 $m^3$ of water has been removed, i.e. after about 30 seconds, the annular buoy is pressed against the underface of the turret with an upwardly-directed vertical force corresponding to the section of the inside surface S that is defined by the gasket 100 multiplied by the hydrostatic pressure that corresponds to the level $H_2$, i.e. that corresponds to the weight of the volume V of water, where $V=S\times(H_0-H_2)$. By way of example, the above-described annular buoy has a valve chamber with a diameter of 22.5 m at the gasket 100 and is situated at a depth $H_2$=20 m, thus corresponding substantially to a pressure of 2 bars, so it is pressed against the turret with an upwardly-directed vertical force of about 8000 t. When the valve chamber 30 is empty, it is at atmospheric pressure and is made accessible via a manhole 24 having a cover 24*a* that is watertight in the closed position when the annular buoy is disconnected, or while the valve chamber is being emptied or filled.

Figure 8:
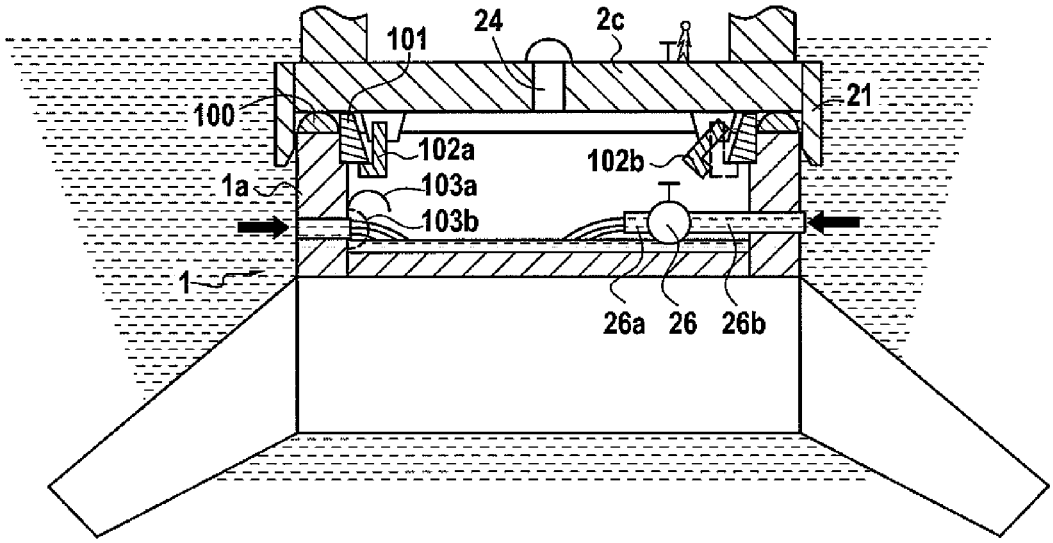
FIG. 8 is a side view in section showing the connections between the underface of the turret and the top portion of the buoy, and the means for flooding the valve chamber with sea water.

Once the valve chamber 30 has been emptied, the hoist cables are no longer necessary and they are preferably disconnected so as to make it easier subsequently to cast off the annular buoy, should that be necessary. Advantageously, a safety latch device as shown in FIG. 8 is placed against the underface of the turret and is constituted, for example, by a movable hinge portion 102 secured to said turret underface on cooperating with a post 101 secured to the annular buoy, said post being common with the abutment limiting flattening of the elastomer gasket 100, for example. Thus, in the event of the valve chamber being flooded, the loss of buoyancy of the annular buoy is compensated by the safety latches and there is no risk of said annular buoy being cast off in unintended and destructive manner.

Figure 7:
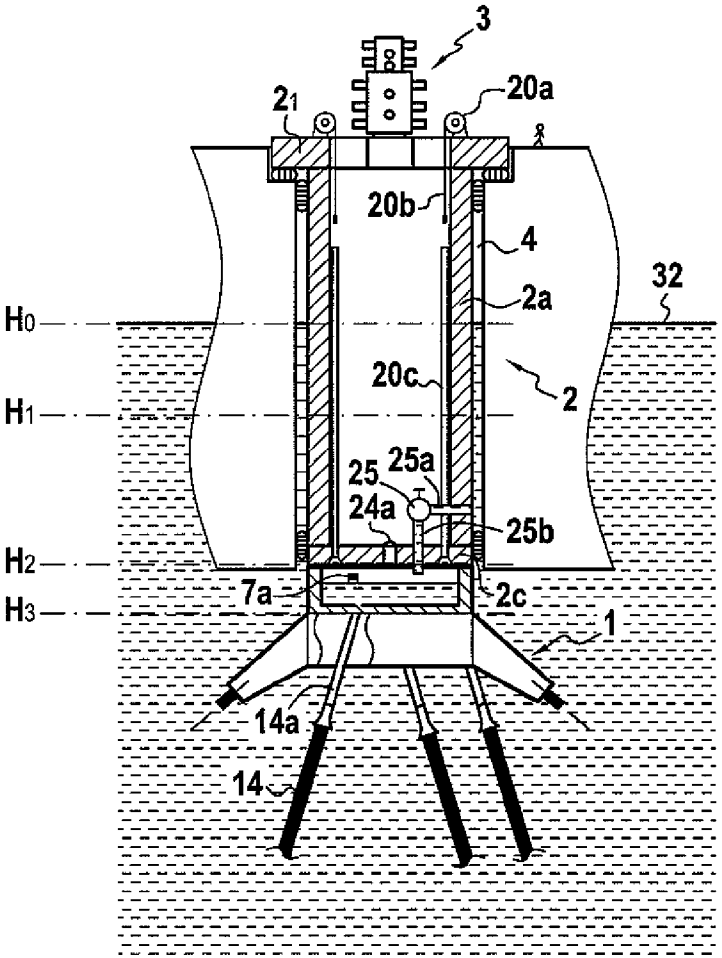
FIG. 7 is a side view in section showing the initial step of disconnecting the buoy from the turret by flooding the valve chamber with sea water, during the casting-off procedure.
Figure 6:
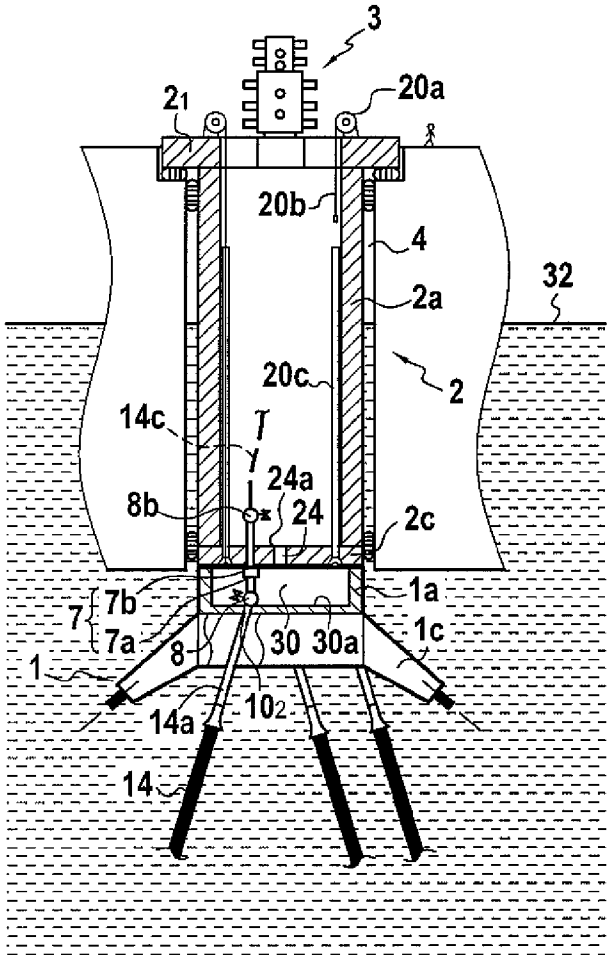
FIG. 6 is a side view in section showing the turret and the valve chamber in continuous operation and made accessible to personnel $\mathbf{10}_2$ since it is then at atmospheric pressure.

If it is necessary to disconnect the FPSO, e.g. because of a storm, an iceberg, or pack ice threatening the installation as a whole, the disconnection is advantageously performed using the following preferred procedure that is described with reference to FIGS. 7 and 8:

- the access hatch 24*b* to the valve chamber is closed in watertight manner; and
- the hoist cables 20*b* are disconnected from the annular buoy and, where appropriate, fully extracted from the guide pipes 20*c*, with the safety latches 102 still being engaged, and the valve 25 is opened, putting said valve chamber into communication with the sea via filler pipes 25*a*-25*b* that pass respectively through the tubular side wall 2 in the bottom portion of the turret and through the bottom wall 2*c* of the turret, thereby beginning to fill the valve chamber, with the guide tubes 20*c* acting as vents so as to maintain the valve chamber substantially at atmospheric pressure throughout said filling operation; and
- filling is stopped by reclosing the valve 25 when the valve chamber is completely full, this representing a volume of sea water equal to about 2000 $m^3$ in the above-described example, i.e. when the level of the water inside the valve chamber reaches the $H_2$ mark.

In this position, the annular buoy is still held in position by hydrostatic thrust (F=the weight of the volume of water $V_2=S\times(H_0-H_2)$), and the casting-off process can be reversed merely by emptying the chamber as described above with reference to FIG. 3. During this filling stage that may last for 10 minutes (min) to 45 min, depending on the number of valves 25 and of filler pipes 25*a*-25*b*, and depending on their respective diameters, it is advantageous to depressurize all of the flexible pipes down to the well heads, and more particularly the gas pipes that are under very high pressure, with the gas therefrom being sent to the flare tower of the FPSO in order to be burned off.

When disconnection is confirmed in definitive manner:

- the safety latches 102 are unlocked by making them pivot from their engaged positions 102*a* to their retracted positions 102*b;* and
- at least one of the valves 25 is opened wide so as to finish off filling the guide tubes 20*c*, with this representing only a small volume, of the order of a few $m^3$ in the above-described example.

As soon as the water reaches the level $H_1$, the buoyancy of the annular buoy is reduced from the value $F_3$=the weight of the volume of water $V_3=S\times(H_0-H_3)$ to the value $F_1$=the weight of the volume of water $V_1=S\times(H_0-H_1)$. When the dead weight of the assembly constituted by the annular buoy, the flexible pipes, and the anchor lines exceeds the value $F_1$, the annular buoy naturally begins to separate from the turret and as a result said annular buoy begins to move downwards, the gasket 100 no longer provides sealing and allows sea water to penetrate at an almost infinite rate. The annular buoy is thus immediately at a hydrostatic level that corresponds to sea level, i.e. $H_0$, and said annular buoy drops downwards under considerable force corresponding to its dead weight, i.e. about 500 t to 1500 t, thereby releasing the FPSO from its anchoring on the turret, in quasi-instantaneous manner.

Between being triggered and actually taking effect, this final stage requires only 3 $m^3$ to 4 $m^3$ of water to be transferred in the above-described example for the purpose of filling the guide pipes 20*c* that act as vents, so it takes only a few seconds, or at worst only a few tens of seconds. Once the hydrostatic level $H_1$ is reached, the annular buoy begins to move downwards, but the gasket 100 remains in a compressed state and continues to provide sealing. In order to continue the casting-off process, it is appropriate to continue to allow water to enter until the gasket is uncompressed and starts to allow sea water to go past, thereby causing the annular buoy to be cast off suddenly. By way of example, for a gasket compressed over a thickness of 20 mm, and in the above-described example of a valve chamber having a diameter of 22.5 m, this requires about 10 $m^3$ of additional sea water, and thus does not greatly increase disconnection time.

It is also possible to fill the valve chamber 30 using lateral valves 26 and filler pipes 26*a*-26*b* passing through said top tubular wall la of the mooring buoy 1, as shown in FIG. 8.

In order to obtain quasi-instantaneous disconnection, it is advantageous to make use of a watertight hatch of large dimensions 103 that is held in a closed position 103*b* in normal operation and during the preliminary disconnection stage by a trigger device or by explosive bolts (not shown), and that is subsequently remotely actuated in known manner to release said watertight hatch, which allows sea water to pass freely once it is in the position 103*a*. Casting off then takes place almost instantaneously.

In the above description, said tubular top wall 1*a* of the mooring buoy is described as being defined by a cylindrical surface having a vertical axis ZZ', and preferably of circular section. However, it can be understood that said top tubular wall 1*a* may be defined by a surface of revolution having a vertical axis ZZ' traced by a straight generator line that is inclined relative to the axis ZZ', said top tubular wall then presenting a shape that is frustoconical, or said generator line may be curved, the essential point being to define a side wall having a top edge 1*b* that is suitable for coming into contact with the underface of the bottom wall 2*c* of the turret 2 and also to have a bottom end that is assembled in watertight manner to the periphery of the bottom wall 30*a* of the chamber 30 so as to define a valve chamber 30 that is watertight when the top edge of the side wall of said valve chamber comes into contact with the bottom wall 2*c* of the turret 2.

In the description of the various figures, the winches 20*a* are shown installed at the level of the deck of the FPSO and the corresponding hoist cables 20*b* pass along the guide pipes 20*c*, which pipes also act as vents, however it would remain within the spirit of the invention if the winches were to be incorporated in the structure of the turret at the bottom thereof. The winches would then be directly in the water and the cables would be connected directly to the buoy: at least one pipe 20*c* would then need to be provided to act solely as a vent.

The invention claimed is:

1. An oil production floating support including a disconnectable mooring system of anchor lines anchored to a bottom of a sea and of bottom-to-surface connection pipes, the support comprising:

a mooring buoy for said anchor lines and first bottom-to-surface connection pipes extending from said buoy, to which the anchor lines and first bottom-to-surface connection pipes are moored, down to the bottom of the sea;

a turret extending in a through cavity passing along an entire height of a hull of the floating support, said mooring buoy being fastened under the hull of the floating support to said turret, said turret co-operating with the hull within said through cavity passing along the entire height of the hull of the floating support, said turret being rotatably mounted relative to said hull by means of at least one rolling or friction bearing situated at at least one of above the water line and out of the water so as to allow said floating support to turn about a substantially vertical axis ZZ' of said turret and of said cavity without causing said mooring buoy to turn relative to the same vertical axis ZZ'; and said turret including at least one watertight tubular structure having a bottom wall assembled in a watertight manner to a bottom end of a tubular side wall of said tubular structure; and second connection pipes between top ends of said first bottom-to-surface connection pipes and a deck of the floating support, passing in a watertight manner through the bottom of the turret and rising within the cavity to a coupling for coupling a plurality of said second pipes, said coupling being secured to the floating support, said coupling being of the rotary joint coupling type and being rotatably mounted so as to allow said floating support to turn without turning said coupling;

the support further comprising:

said mooring buoy comprises a top tubular wall having valves situated therein, said tubular top wall of the buoy co-operating with the bottom wall of said turret to define a watertight valve chamber when the top edge of said tubular top wall of the buoy is pressed against the bottom wall of said turret, against the underface thereof; and said floating support includes a connection/disconnection system for connecting/disconnecting said mooring buoy relative to said bottom wall of the turret, said system comprising:

a plurality of links fastened to said mooring buoy;

at least one vent tube extending vertically inside the turret from a level above the water line to the bottom wall of the turret and passing through the bottom wall in a watertight manner and in fluid communication with said valve chamber; and pump means for pumping water in said valve chamber when said tubular top wall of the buoy is pressed against said bottom of the turret;

the dead weight of said mooring buoy and of said first bottom-to-surface connection pipes and of the anchor lines being less than the weight of a volume of water corresponding to the volume $V=S3\ (H_0-H_2)$ in which:

$H_0$ is the height of the water at the water line;

$H_2$ is the height of the top edge of said top tubular wall of the buoy in contact with the bottom wall of the turret; and S is the area of the cross-section of said top tubular wall.

2. The floating support according to claim 1, wherein a plurality of said links including hoist cables extend from winches located on the deck of the floating support or at the top of said turret, above the water line, said cables where appropriate extending inside a plurality of said vent tubes extending vertically inside the turret from a level above the water line down to the bottom of the turret through which said vent tubes pass in a watertight manner.

3. The floating support according to claim 2, further comprising at least three said hoist cables and at least three said vent tubes.

4. The floating support of claim 3, wherein said at least three cables and said at least three vent tubes are disposed symmetrically about the center of the circular bottom of said turret and along and close to the inside surface of the tubular structure of said turret, the bottom ends of said cables being fastened to the top edge of the top tubular wall of said buoy.

5. The floating support according to claim 1, wherein the diameter of said at least one vent tube and the immersion depth $H_0$-$H_2$ of the bottom wall of the turret on which said at least one vent tube rests are such that an inside volume of the at least one vent tube is less than 15 $m^3$.

6. The floating support according to claim 1, wherein said top tubular wall of the buoy includes at a bottom end thereof a bottom wall to which the buoy is assembled in a watertight manner, forming the bottom wall of the valve chamber supporting said valves and/or automatic connector portions, and a bottom portion of the buoy includes an annular buoyancy tank constituting a float against the underface of the bottom wall of the valve chamber.

7. The floating support according to claim 1, wherein a pump is situated in the bottom portion inside said watertight tubular structure constituting the turret, said pump co-operating with a suction pipe passing in a watertight manner through said bottom wall of the turret, said suction pipe coming close to the bottom wall of said valve chamber when said suction pipe is in position pressed against said bottom wall of the turret, and said pump co-operating with a delivery pipe passing through the tubular side wall of said watertight tubular structure constituting the turret and opening out into said cavity.

8. The floating support according to claim 1, wherein centering posts are applied against an outside surface of the tubular wall of the turret and extending below said bottom wall of the turret.

9. The floating support according to claim 1, further comprising a reversible mechanical retaining means for retaining said mooring buoy against the underface of the bottom of said turret.

10. The floating support according to claim 1, wherein said tubular top wall of said buoy has an annular gasket on a top edge thereof, and has protective posts or abutments on an inside face thereof for limiting the flattening of said gasket and for transferring vertical loads between said annular buoy and the turret when said mooring buoy is pressed against the bottom wall of said turret, said annular gasket being compressed between the underface of the bottom wall of said turret and the top edge of the tubular top wall of said mooring buoy, said protective post being suitable for co-operating with a hinged movable safety latch secured to the underface of the bottom wall of said turret, whereby said mooring buoy is secured to said turret when said safety latch is engaged under said protective post.

11. The floating support according to claim 1, wherein said top tubular wall of the buoy and/or the tubular side wall of the watertight tubular structure of said turret include(s) a filler valve co-operating with filler pipes for putting sea water into communication with the inside of said valve chamber.

12. The floating support of claim 11, wherein said tubular wall of said valve chamber includes a watertight hatch of large dimensions suitable for enabling said valve chamber to be filled almost instantaneously by sea water when said hatch is opened.

13. The floating support according to claim 1, wherein the bottom wall of the turret includes an inspection hatch for inspecting said valve chamber.

14. The floating support of claim 1, wherein said buoy comprises an annular buoy, wherein said coupling is secured to the floating support at the level of the deck of the floating support, and wherein said links are fastened to the top edge of said tubular top wall of the mooring buoy, and said link extending inside the turret passing through the bottom wall of the turret in a leaktight manner.

15. A method of operating the floating support according to claim 1, wherein said mooring buoy is connected to the underface against the bottom wall of said turret by performing the following steps:

a) immersing said mooring buoy, said buoy having said first bottom-to-surface connection pipe and anchor lines moored thereto;

b) securing the bottom ends of said links to said mooring buoy, said floating support being positioned such that said mooring buoy is substantially on the vertical axis of said cavity;

c) actuating winches to raise said mooring buoy until the top edge of said tubular top wall of the mooring buoy is pressed against the underface of the bottom wall of said turret, thereby forming said valve chamber that is filled with sea water, said at least one vent tube also being filled with sea water up to a height $H_0$ corresponding substantially to the level of the water surface at the water line; and d) pumping out the water inside said valve chamber using said pump means until the level of water in said at least one vent tube is less than the height $H_1$, where the height $H_1$ is such that the weight of a volume V1 of water, where $V1=S3\ (H_0-H_1)$, is equal at least to a weight of the assembly of said mooring buoy and of said connection pipes and said anchor lines.

16. The method according to claim 15, wherein after said valve chamber has been emptied, the bottom ends of said links are detached from said mooring buoy, and a retaining means for mechanically retaining said mooring buoy are engaged, thereby securing the buoy to the bottom wall of said turret.

17. The method according to claim 15, wherein the floating support is disconnected from said mooring buoy connected to said turret, wherein after the bottom ends of said links have been separated from said mooring buoy, the method comprises the following steps:

a) causing water to enter into the valve chamber, so that the water level in said at least one vent tube comes to above said level $H_1$; and b) where appropriate, releasing the automatic connectors between said first and second pipes and releasing said mechanical retaining means in order to separate said mooring buoy mechanically from said bottom wall of the turret.

18. The method according to claim 17, wherein the following steps are performed:

a) where appropriate, depressurizing said first and second bottom-to-surface connection pipes;

b) filling said valve chamber up to said height $H_2$ of the underface of the bottom wall of the turret, and stopping filling as soon as said valve chamber is completely full of water;

c) releasing the automatic connectors between said first and second pipes;

d) releasing, where appropriate, said mechanical safety latches; and e) continuing to fill said valve chamber so as to fill the at least one vent tube up to said height $H_1$.

19. The method of claim 15, further comprising the step of completely emptying said valve chamber and then making the valve chamber watertight.

20. The method of claim 16, wherein the buoy is secured to the bottom wall of the turret using a hinged movable safety latch suitable for co-operating with protective posts preventing an annular gasket that is compressed between the top edge of the tubular top wall of the mooring buoy and the underface of the bottom wall of the turret from being flattened.

21. The method of claim 15, wherein the height $H_1$ is less than or equal to the height $H_2$.

* * * * *

UNITED STATES PATENT AND TRADEMARK OFFICE

CERTIFICATE OF CORRECTION

PATENT NO. : 8,342,777 B2
APPLICATION NO. : 12/933837
DATED : January 1, 2013
INVENTOR(S) : Baylot et al.

It is certified that error appears in the above-identified patent and that said Letters Patent is hereby corrected as shown below:

In the Claims

Column 14, Claim 1, line 57-60 should read the dead weight of said mooring buoy and of said first bottom-to-surface connection pipes and of the anchor lines being less than the weight of a volume of water corresponding to the volume $V=S\times(H_0 - H_2)$ in which:

Column 16, Claim 15, line 39-46 should read d) pumping out the water inside said valve chamber using said pump means until the level of water in said at least one vent tube is less than the height $H_1$, where the height $H_1$ is such that the weight of a volume V1 of water, where $V1=S\times(H_0-H_1)$, is equal at least to a weight of the assembly of said mooring buoy and of said connection pipes and said anchor lines.

Signed and Sealed this
Eleventh Day of February, 2014

Michelle K. Lee

Michelle K. Lee
*Deputy Director of the United States Patent and Trademark Office*